United States Patent [19]

Nakajima et al.

[11] Patent Number: 4,869,652

[45] Date of Patent: Sep. 26, 1989

[54] VARIABLE CAPACITY COMPRESSOR

[75] Inventors: Nobuyuki Nakajima; Kenichi Inomata; Masaya Moruta; Toshio Yamaguchi; Kazuo Eitai, all of Konan, Japan

[73] Assignee: Diesel Kiki Co., Ltd., Tokyo, Japan

[21] Appl. No.: 316,506

[22] Filed: Feb. 27, 1989

[30] Foreign Application Priority Data

Mar. 16, 1988 [JP] Japan ..... 63-62724
Mar. 16, 1988 [JP] Japan ..... 63-62723

[51] Int. Cl.[4] ..... F04B 49/02; F04C 29/08
[52] U.S. Cl. ..... 417/295; 417/310
[58] Field of Search ..... 417/295, 310

[56] References Cited

U.S. PATENT DOCUMENTS 4,744,732 5/1988 Nakajima et al. ..... 417/310
4,815,945 3/1989 Nakajima et al. ..... 417/310

*Primary Examiner*—William L. Freeh
*Attorney, Agent, or Firm*—Frishauf, Holtz, Goodman & Woodward

[57] ABSTRACT

A variable capacity vane compressor having compression spaces defined between a cylinder and a rotor at diametrically opposite locations. A control element rotatably arranged in the cylinder, which has two cut-out portions circumferentially extending at diametrically opposite locations through which inlet ports and respective corresponding compression spaces are communicatable with each other. The cut-out portions are disposed relative to the respective corresponding compression spaces such that compression commences in each of the compression spaces when a trailing vane passes a forward end edge of a corresponding cut-out portion with respect to the rotation of the rotor. The control element is rotatable between a partial capacity position and a full capacity position for varying the capacity of the compressor. The forward end edge of one cut-out portion associated with one compression space has a circumferentially extending recess formed in a radially inner portion thereof, and a projecting portion formed by a radially outer portion thereof, whereby compression commences in the one compression space at retarded timing as compared with the other compression space when the control elements is in the full capacity position.

6 Claims, 8 Drawing Sheets

VARIABLE CAPACITY COMPRESSOR

BACKGROUND OF THE INVENTION

This invention relates to a variable capacity compressor which varies the compression starting timing to thereby control the delivery quantity or capacity thereof, and more particularly to a compressor of this kind which has a sufficiently wide variable range of the delivery quantity or capacity.

As a conventional variable capacity vane compressor of this kind, a vane compressor has been proposed by U.S. Pat. No. 4,813,854 assigned to the present assignee, in which the compression starting timing is different between two compression spaces defined within the cylinder, that is, the compression stroke in one compression space commences at a retarded timing, as compared with that in the other compression space, thereby reducing the minimum delivery quantity or capacity of the one compression space and hence providing a wide variable range of delivery quantity or capacity of the compressor, while obtaining a sufficiently high level of discharge pressure during partial capacity operation of the compressor.

The proposed compressor has a control element having two cut-out portions formed in an outer peripheral edge thereof at almost diametrically opposite locations, except that one cut-out portion has one forward end edge with respect to the rotation of the rotor, which is located asymmetrically with an forward end edge of the other cut-out portion such that the compression starting timing in the one compression space is retarded as compared with that in the other compression space. The position of the one forward end edge of each cut-out portion determines the compression starting timing in the corresponding compression space. Therefore, when the compressor is in a full capacity operation, as well as in partial capacity operation, the compression starting timing in the one compression space is retarded as compared with that in the other compression space, thereby resulting in reduced delivery quantity or capacity in the one compression space and hence reduced total maximum delivery quantity or capacity of the compressor during full capacity operation.

Further, in the proposed compressor, the control element is controlled by control pressure created from high pressure or discharge pressure supplied from either one of the compression spaces. If the high pressure for creating the control pressure is supplied from the one compression space, whose delivery quantity or capacity is smaller than that of the other compression space at partial capacity operation of the compressor, when the compressor is started where the control element is in the partial capacity position so that the compression starting timing in the one compression space is retarded as compared with the other compression space, the control pressure does not promptly increase to a high level sufficient to cause rotation of the control element toward increased delivery quantity or capacity of the compressor at the start thereof, thus resulting in poor startability of the compressor.

SUMMARY OF THE INVENTION

It is the object of the invention to provide a variable capacity compressor which is capable of retarding the compression starting in one compression space as compared with that in the other compression space during partial capacity operation of the compressor, while maintaining the former almost the same as the latter during full capacity operation, whereby the variable range of the capacity of the one compression space is wider than that of the other compression space to obtain a wider variable range of capacity of the whole compressor.

It is a further object of the invention to provide a variable capacity compressor which has improved startability, while obtaining a sufficiently wide variable range of capacity of the compressor.

According to the invention, there is provided a variable capacity vane compressor having a cylinder, a rotor rotatably received within the cylinder, a plurality of vanes radially slidably carried by the rotor, a pair of compression spaces defined between the cylinder and the rotor at diametrically opposite locations, a pair of refrigerant inlet ports formed in the cylinder in communication with respective corresponding ones of the compression spaces, a control element rotatably arranged in the cylinder, the control element having two cut-out portions formed therein and circumferentially extending at diametrically opposite locations through which the inlet ports and respective corresponding ones of the compression spaces are communicatable with each other, the cut-out portions being disposed relative to the respective corresponding ones of the compression spaces such that compression commences in each of the compression spaces when a trailing one of two successive ones of the vanes passes a forward end edge of a corresponding one of the cut-out portions with respect to the rotation of the rotor, the control element being rotatable between a partial capacity position and a full capacity position for varying the capacity of the compressor.

The variable capacity vane compressor according to the invention is characterized by the improvement wherein the forward end edge of one of the cut-out portions associated with one of the compression spaces has a circumferentially extending recess formed in a radially inner portion thereof, and a projecting portion formed by a radially outer portion thereof, whereby compression commences in the one of the compression spaces at retarded timing as compared with the other of the compression spaces when the control element is in the full capacity position.

Preferably, the forward end edge of the one of the cut-out portions may be formed such that most part of the projecting portion thereof intervenes between the one of the compression spaces and a corresponding one of the refrigerant inlet ports when the control element is in the full capacity position, and very little part of the projecting portion thereof intervenes between the one of the compression spaces and the corresponding one of the refrigerant inlet ports when the control element is in the partial capacity position.

More preferably, a variable capacity vane compressor may include at least one pair of first and second pressure chambers formed in the cylinder and disposed to be supplied, respectively, with lower pressure and higher pressure, the control element being rotatable in response to the difference between pressure within the first pressure chamber and pressure within the second pressure chamber, and pressure-supply means for supplying discharge pressure from the other of the compression spaces to the second pressure chamber.

Further preferably, the first pressure chamber may be supplied with suction pressure in the compressor.

According to the invention, there is also provided a variable capacity compressor having a cylinder, a pair of compression spaces defined in the cylinder at diametrically opposite locations, a control element rotatably arranged in the cylinder, the control element having two cut-out portions formed in an outer peripery thereof and disposed relative to respective corresponding ones of the compression spaces such that compression starting timing in each of the compression spaces is determined by circumferential position of a corresponding one of the cut-out portions, the cut-out portions being different in at least one of configuration and circumferential position thereof from each other such that compression starting timing in one of the compression spaces is retarded as compared with that in the other of the compression spaces, and at least one pair of first and second pressure chambers formed in the cylinder, the control element being rotatable in response to the difference between pressure within the first pressure chamber and pressure within the second pressure chamber.

The variable capacity compressor according to the invention is characterized by the improvement comprising pressure-supply means for supplying discharge pressure from the other of the compression spaces to the second pressure chamber.

The above and other objects, features and advantages of the invention will become more apparent from the ensuing detailed description taken in conjunction with the accompanying drawings.

DETAILED DESCRIPTION

Figure 1:
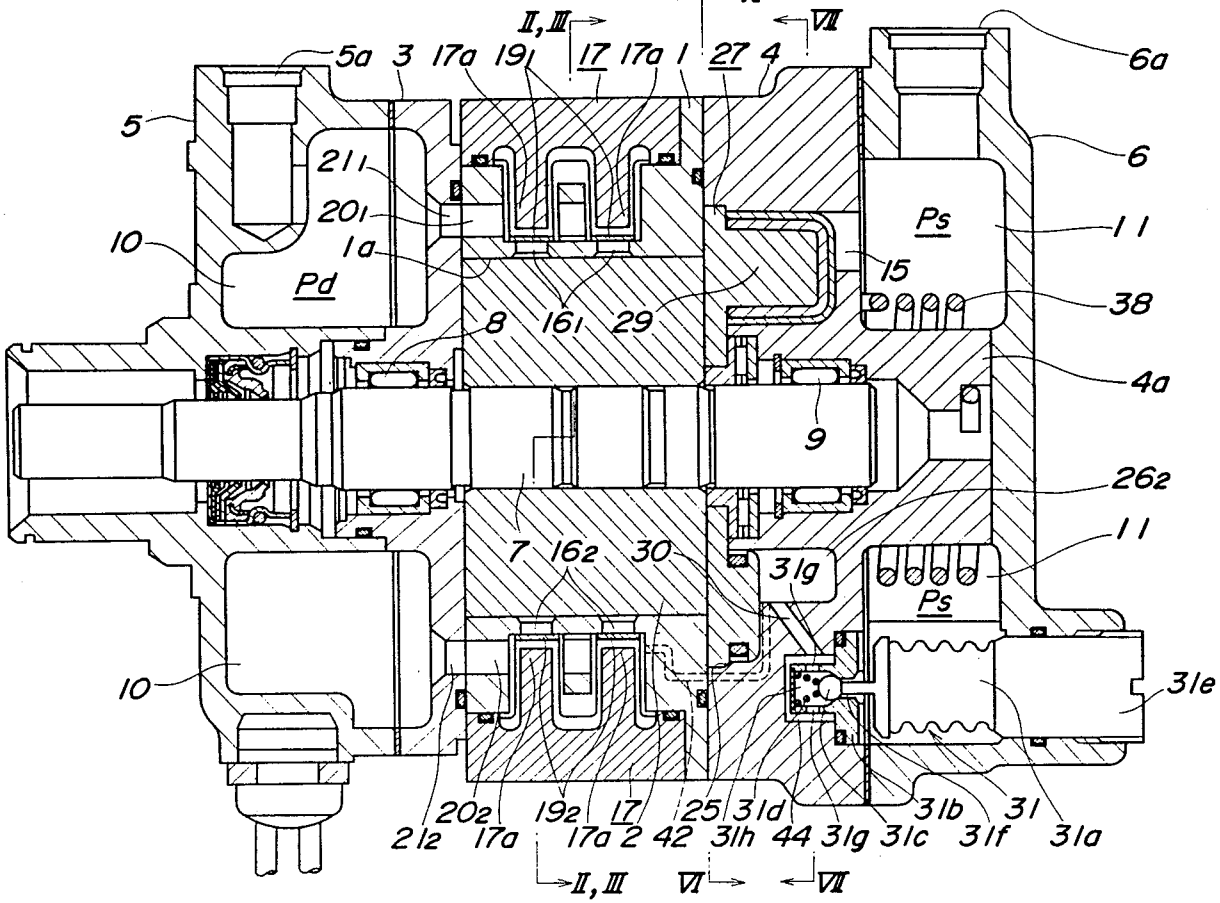
FIG. 1 is a longitudinal sectional view of a variable capacity compressor according to the invention.

The invention will now be described in detail with reference to the drawings showing embodiments thereof. Corresponding elements and parts are designated by identical reference numerals throughout all the figures.

FIGS. 1 through 7 show a variable capacity vane compressor according to a first embodiment of the invention.

Figure 2:
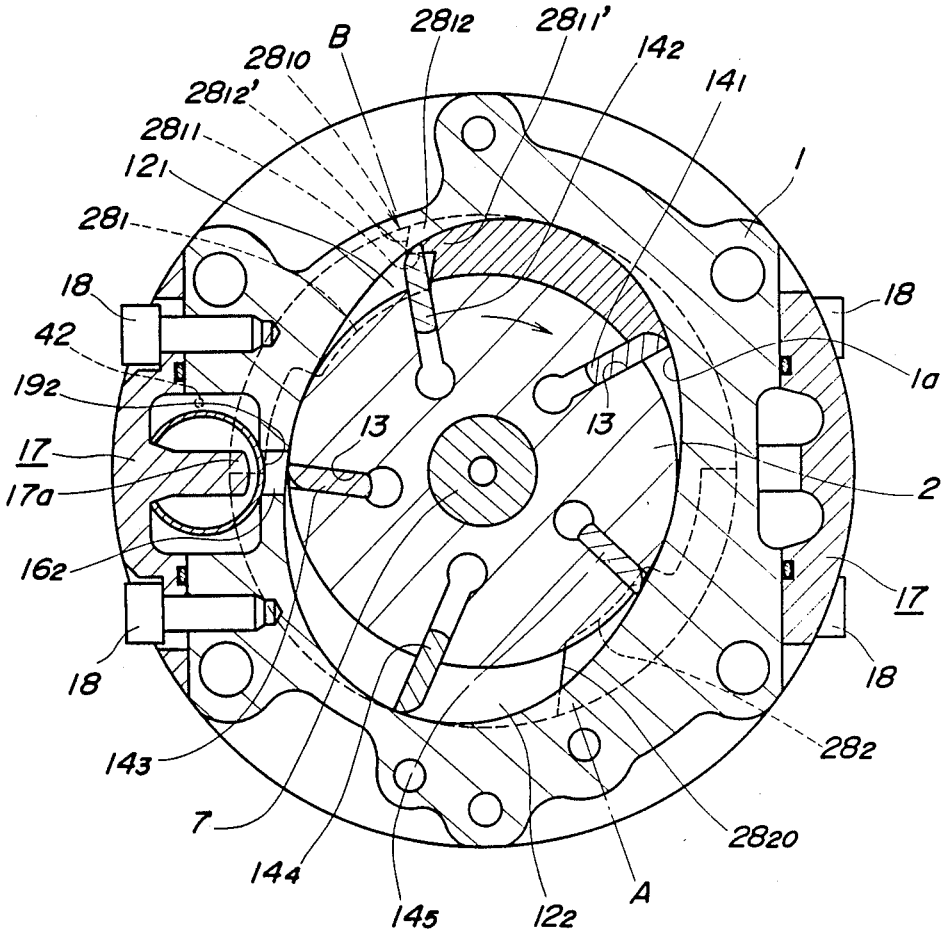
FIG. 2 is a transverse sectional view taken along line II—II in FIG. 1.

As shown in FIGS. 1 and 2, the variable capacity vane compressor is composed mainly of a cylinder formed by a cam ring 1 having an inner peripheral camming surface 1*a* with a generally elliptical cross section, and a front side block 3 and a rear side block 4 closing open opposite ends of the cam ring 1, a cylindrical rotor 2 rotatably received within the cylinder, a front head 5 and a rear head 6 secured to outer ends of the respective front and rear side blocks 3 and 4, and a driving shaft 7 on which is secured the rotor 2. The driving shaft 7 is rotatably supported by a pair of radial bearings 8 and 9 provided in the respective side blocks 3 and 4.

A discharge port 5*a* is formed in an upper wall of the front head 5, through which a refrigerant gas is to be discharged as a thermal medium, while a suction port 6*a* is formed in an upper wall of the rear head 6, through which the refrigerant gas is to be drawn into the compressor. The discharge port 5*a* and the suction port 6*a* communicate, respectively, with a discharge pressure chamber 10 defined by the front head 5 and the front side block 3, and a suction chamber 11 defined by the rear head 6 and the rear side block 4.

As shown in FIG. 2, a pair of compression spaces $12_1$, $12_2$ are defined at diametrically opposite locations between the inner pheripheral camming surface 1*a* of the cam ring 1, an outer peripheral surface of the rotor 2, an end face of the front side block 3 on the cam ring 1 side, and an end face of a control element 27 on the cam ring 1 side.

The rotor 2 has its outer peripheral surface formed therein with a plurality of (five in the illustrated embodiment) axial vane slits 13 at circumferentially equal intervals, in each of which a vane $14_1$–$14_5$ is radially slidably fitted.

Figure 6:
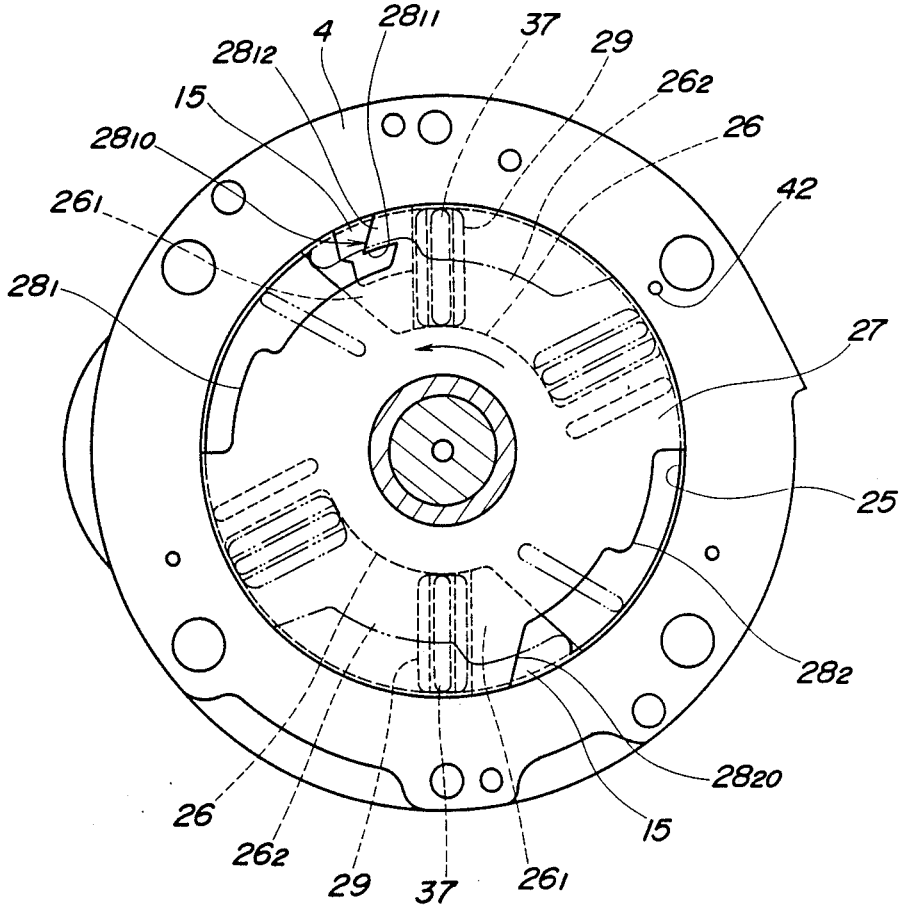
FIG. 6 is a transverse sectional view taken along line VI—VI in FIG. 1.

Refrigerant inlet ports 15, 15 are formed in the rear side block 4 at diametrically opposite locations, as shown in FIGS. 1 and 6. These refrigerant inlet ports 15, 15 are located at such locations that they become closed when a compression chamber defined between successive two vanes $14_1$–$14_5$ assume the maximum volume. These refrigerant inlet ports 15, 15 axially extend through the rear side block 4 and through which the suction chamber 11 and the compression spaces $12_1$ and $12_2$ are communicated with each other.

A plural pairs of, e.g., two pairs of, refrigerant outlet ports $16_1$, $16_2$, each port having two openings, are formed through opposite lateral side walls of the cam ring 1 at diametrically opposite locations, as shown in FIGS. 1 and 2, though only one of which is shown in FIG. 2. The cam ring 1 has opposite lateral side walls thereof provided with respective discharge valve covers 17, 17, each formed integrally with a valve stopper 17*a*, and fixed to the cam ring 1 by fixing bolts 18. The valve covers 17, 17 each have a discharge valve $19_1$, $19_2$ supported thereby so that the valve $19_1$, $19_2$ is deformable between the outer opening of the refrigerant outlet port $16_1$, $16_2$ and the valve stopper 17*a*. Accordingly, the discharge valve $19_1$, $19_2$ opens in response to discharge pressure Pd to thereby open the refrigerant outlet port $16_1$, $16_2$. Further formed in the cam ring 1 at diametrical opposite locations are a pair of passages $20_1$, $20_2$ which communicate, respectively, with the refrigerant outlet ports $16_1$, $16_2$ when the associated discharge valve $19_1$, $19_2$ opens. A pair of passages $21_1$, $21_2$ are formed in the front side block 3, which communicate, respectively, with the passages $20_1$, $20_2$.

With such arrangement, when the discharge valves $19_1$, or $19_2$ open to thereby open the refrigerant outlet ports $16_1$ or $16_2$ a compressed refrigerant gas in the associated compression space $12_1$ or $12_2$ is discharged from the discharge port 5*a* via the refrigerant discharge outlet ports $16_1$ or $16_2$ the passages $20_1$, $21_1$, or $20_2$, $21_2$ and the discharge pressure chamber 10, in the mentioned order.

Figure 4:
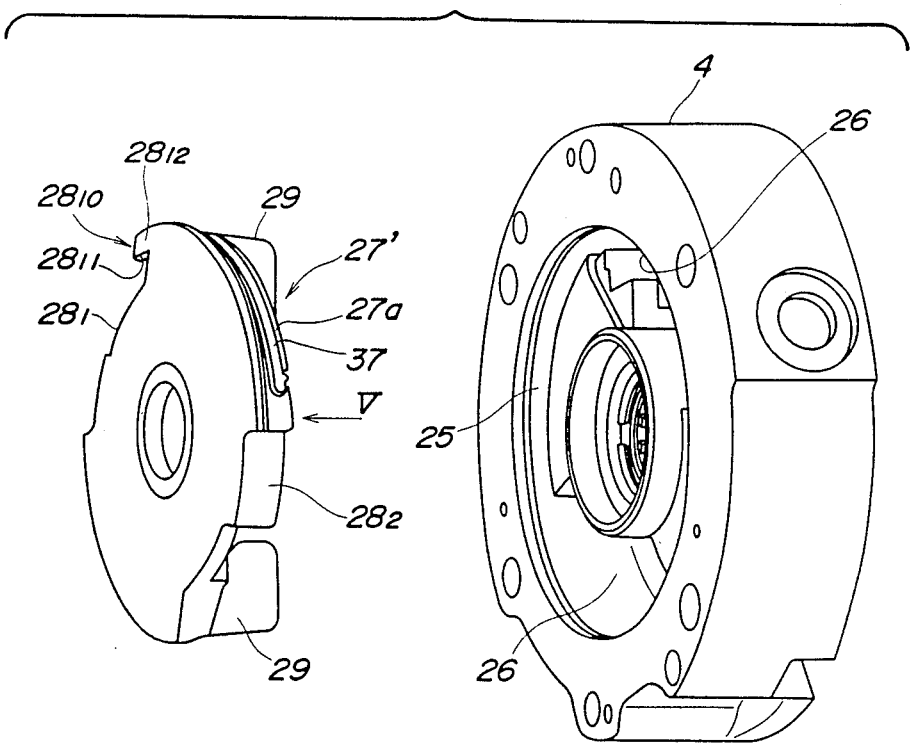
FIG. 4 is an exploded perspective views of a rear side block and a control element slidably received therein.

As shown in FIGS. 1 and 4, the rear side block 4 has an end face facing the rotor 2, in which is formed an annular recess 25. A pair of pressure working chambers 26, 26 are formed in a bottom of the annular recess 25 at diametrically opposite locations.

A control element 27, which is in the form of an annulus, is received in the annular recess 25 for rotation about its own axis in opposite circumferential directions. The control element 27 has its outer peripheral edge formed with two diametrically opposite arcuate cut-out portions $28_1$ $28_2$, and its one side surface formed integrally with a pair of diametrically opposite pressure-receiving protuberances 29, 29 axially projected therefrom and acting as pressure-receiving elements.

Figure 5:
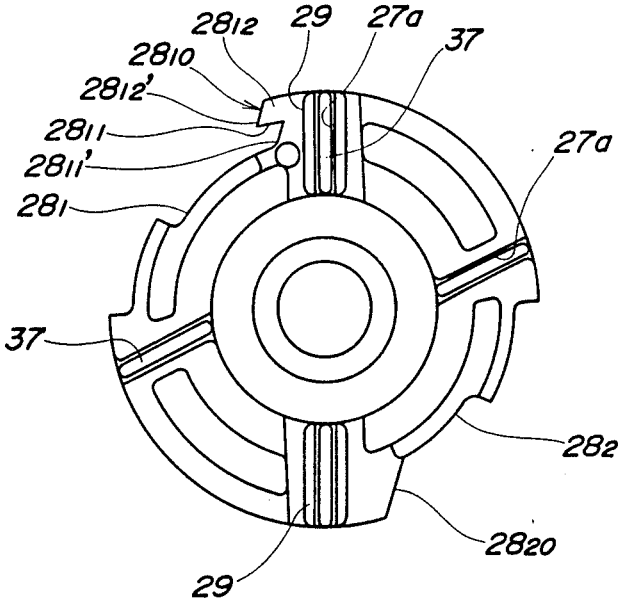
FIG. 5 is a plan view of the control element according to the invention.
Figure 9:
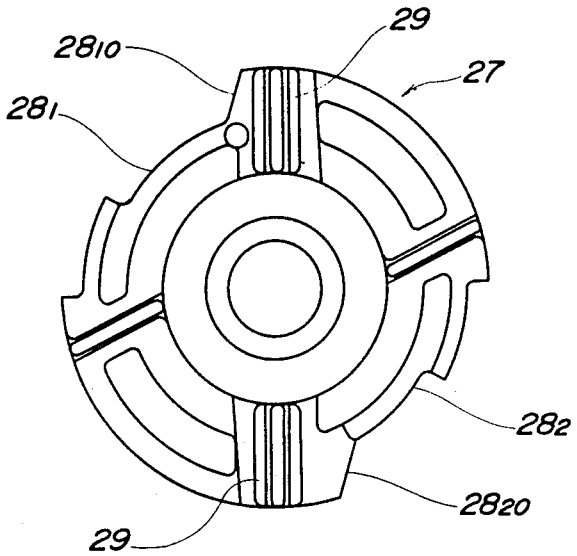
FIG. 9 is a plan view of another control element to which the other pressure supply system of the invention can be applied.

As shown in FIG. 5, the two cut-out portions $28_1$, $28_2$ are configured in shapes different from each other such that when the control element 27 is in a partial capacity position, the timing of commencement of the compression stroke (compression starting timing) in one compression chamber $12_1$ is retarded as compared with the timing of commencement of the compression stroke in the other compression space $12_2$, thereby setting the variable range of delivery quantity or capacity of the one compression space $12_1$ wider than that of the other compression space $12_2$. More specifically, these cut-out portions $28_1$, $28_2$ are at almost diametrically opposite locations, but one cut-out portion $28_1$ has its forward end edge $28_{10}$, with respect to the rotation of the rotor 2, having a circumferentially extending recess $28_{11}$ formed in an inner half thereof with an outer half left as a projecting portion $28_{12}$, whereas the other cut-out portion $28_2$ has its forward end edge $28_{20}$, with respect to the rotation of the rotor 2, formed straight (exactly, obliquely extending straight).

The control element 27, having the cut-out portions $28_1$, $28_2$ differently configured as above, is slidably received in the annular recess 25 for rotation about its own axis so that the one cut-out portion $28_1$ serves to vary the timing of commencement of the compression stroke in the one compression space $12_1$, and the other cut-out portion $28_2$ the timing of commencement of the compression stroke in the other compression space $12_2$, respectively.

The interior of each of the pressure working chambers 26, 26 is divided into a first pressure chamber (lower pressure chamber) $26_1$ and a second pressure chamber (higher pressure chamber) $26_2$ by the associated pressure-receiving protuberance 29. Each first pressure chamber $26_1$, $26_1$ communicates with the suction chamber 11 through the corresponding refrigerant inlet port 15 and is supplied with refrigerant gas having suction pressure or low pressure Ps.

Figure 7:
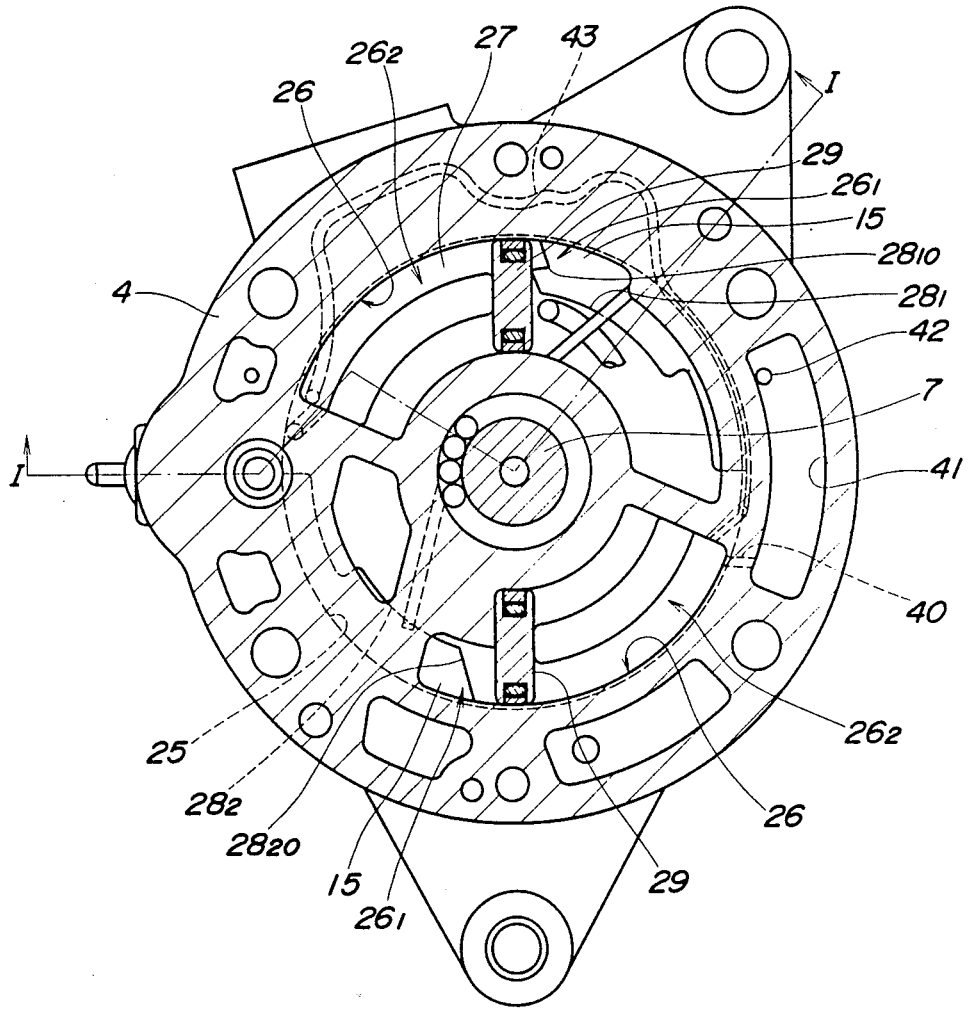
FIG. 7 is a transverse sectional view taken along line VII—VII in FIG. 1.

On the other hand, one second pressure chamber $26_2$ communicates with the passage $20_2$ via a restriction passage 40 and a passage 41, both formed in the rear side block 4, as shown in FIG. 7, and a control pressure-supply port 42 formed in the cam ring 1, as shown in FIGS. 1 and 7. Both the second pressure chambers $26_2$ and $26_2$ are communicated with each other by way of a passage 43 formed therebetween in the rear head 6, as shown in FIG. 7. Consequently, when the discharge valves $19_2$ open to thereby open the refrigerant outlet ports $16_2$, compressed refrigerant gas in the other compression space $12_2$ is introduced through the refrigerant outlet ports $16_2$, the passage $20_2$, the control pressure-supply port 42, the passage 41, and the restriction passage 40 to the one second pressure chamber $26_2$, and part of the refrigerant gas introduced into the chamber $26_2$ is supplied to the other second pressure chamber $26_2$ through the passage 43, thereby creating control pressure Pc within the both second pressure chambers $26_2$, $26_2$. Thus, the control pressure Pc within the chambers $26_2$, $26_2$ is created from discharge pressure Pd supplied solely from the other compression space $12_2$.

Figure 8:
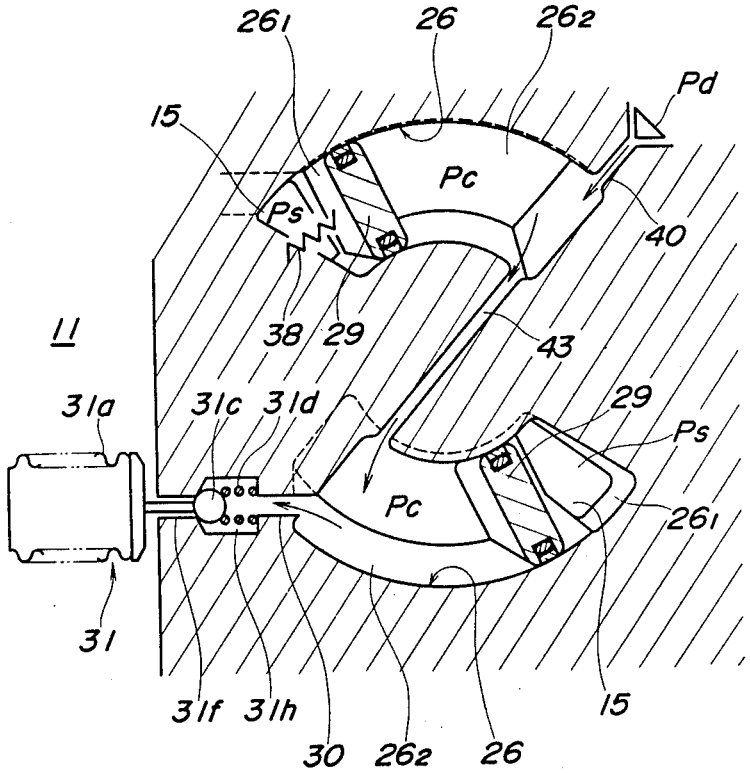
FIG. 8 is a view useful in explaining the operation of a capacity control section of the compressor.

The other second pressure chamber $26_2$ is communicatable with the suction chamber 11 via a passage 30 extending between the chamber $26_2$ and the suction chamber 11 and a control valve device 31, both formed in the rear side block 4, as shown in FIGS. 1 and 8.

The control valve device 31 is operable in response to low pressure or suction pressure Ps within the suction chamber 11, and comprises a flexible bellows 31*a* as a pressure-responsive member, a valve casing 31*b*, a ball valve body 31*c*, a coiled spring 31*d* urging the ball valve body 31*c* in the valve closing direction. The bellows 31*a* is disposed within the suction chamber 11 for expansion and contraction in response to the suction pressure Ps. The valve casing 31*b* is fitted in the valve-receiving space 44 which is formed in the rear side block 4 in communication with the passage 30. With such arrangement, when the suction pressure Ps within the suction chamber 11 is above a predetermined value set by an adjusting member 31*e*, the bellows 31*a* is in a contracted state to bias the ball valve body 31*c* in a position closing a central hole 31*f* formed through the valve casing 31*b*. On the other hand, when the suction pressure Ps is below the predetermined value, the bellows 31*a* is in an expanded state to bias the ball valve body 31*c* in a position opening the central hole 31*f*. Consequently, the aforementioned other second pressure chamber $26_2$ is brought into communication with the suction chamber 11 via the passage 30, the valve-receiving space 44, a pair of radial holes 31*g* formed in the valve casing 31*b*, a chamber 31*h* defined within the valve casing 31*b*, and the central hole 31*f*.

As shown in FIGS. 1 and 6, the control element 27 is urged in the clockwise direction as viewed in FIG. 6 by a torsion coiled spring 38, which is fitted around a hub 4*a* of the rear side block 4 axially extending toward the suction chamber 11 with its one end engaged with one side surface of the control element 27 remote from the rotor 2 and its other end engaged with an end face of the hub 4*a*.

Thus, the control element 27 is rotatable in opposite directions in response to the difference between the sum of the suction pressure Ps within the first pressure chambers $26_1$, $26_1$ and the urging force of the coiled spring 38, and the control pressure Pc within the second pressure chambers $26_2$, $26_2$. To be specific, the control valve device 31 controls the control pressure Pc within the second pressure chambers $26_2$, $26_2$ so as to bring the suction pressure Ps to the predetermined value, wherein the control element 27 rotates in opposite directions between two extreme positions, i.e., a full capacity position shown in FIG. 2 for obtaining the maximum delivery quantity or capacity of the compressor, and a partial capacity position shown in FIG. 3 for obtaining the minimum delivery quantity or capacity.

The operation of the compressor according to the invention constructed as above will now be explained.

When the compressor is started, the suction pressure Ps within the suction chamber 11 is introduced into the first pressure chambers $26_1$, $26_1$ through the refrigerant inlet ports 15, 15, whereas the high pressure or discharge pressure Pd is supplied from the other compression chamber $12_2$ through the refrigerant outlet port $16_2$, the passage $20_2$, the control pressure-supply port 42, the passage 41, and the restriction passage 40 into the one second pressure chamber $26_2$, wherefrom it is further supplied through the passage 43 to the other second pressure chamber $26_2$, thereby creating control pressure Pc within the both second pressure chambers $26_2$ and $26_2$. As a result, the control element 27 rotates in opposite directions in response to the difference between the sum of the pressure Ps within the first pressure chambers $26_1$ and the force of the coiled spring 38 (acting in a direction toward the partial capacity position shown in FIG. 3, or in a clockwise direction as viewed in FIG. 6) and the control pressure Pc within the second pressure chambers $26_2$ (acting in a direction toward the full capacity position shown in FIG. 2, or in a counterclockwise direction as viewed in FIG. 6) between the partial capacity position and the full capacity position.

When the compressor is operating at a low rotational speed, the suction pressure Ps is so high that the control valve device 31 is closed, as shown in FIG. 1, and accordingly the pressure within the second pressure chambers $26_2$, $26_2$ is maintained at a high pressure level. As a result, the control pressure Pc within the second pressure chambers $26_2$, $26_2$ overcomes the sum of the pressure Ps within the first pressure chambers $26_1$, $26_1$ and the force of the coiled spring 38 to cause the control element 27 to rotate into the full capacity position.

In the full capacity position, the respective forward end edges $28_{10}$, $28_{20}$ of the cut-out portions $28_1$, $28_2$ are in the most rearward position with respect to the rotation of the rotor 2. On this occasion, the compression stroke in the other compression space $12_2$ between two successive vanes $14_4$, $14_5$, for example, commences when the trailing vane $14_5$ passes the straight forward end edge $28_{20}$ of the other cut-out portion $28_2$, i.e., passes the position A in FIG. 2. On the other hand, the compression stroke in the one compression space $12_1$ between two successive vanes $14_1$ and $14_2$, for example, commences, when the trailing vane $14_2$ passes the position B in FIG. 2 immediately after passing an edge $28_{12}$, of the projecting portion $28_{12}$ of the cut-out portion $28_1$. Specifically, in the full capacity position, the span between the inner peripheral camming surface 1*a* of the cam ring 1 and the outer peripheral surface of the rotor 2 in the vicinity of the projecting portion $28_{12}$ is so long that most part of the projecting portion $28_{12}$ intervenes between the one compression space $12_1$ and the inlet port 15. Accordingly refrigerant gas within the one compression space $12_1$ hardly leaks through a gap provided between the recess $28_{11}$ and the trailing vane $14_2$ into the inlet port 15. Consequently, the compression stroke in the one compression chamber $12_1$ commences as soon as the trailing vane $14_2$ reaches the aforementioned position B.

This position B is diametrically opposite to the abovementioned position A at which the compression stroke commences in the other compression space $12_2$. Therefore, in the full capacity position, the timing of commencement of the compression stroke in the one compression space $12_1$ is almost the same as that in the other compression space $12_2$, and hence the (maximum) delivery quantity or capacity of the one compression space $12_1$ is almost the same as the (maximum) delivery quantity or capacity of the other compression space $12_2$.

Figure 3:
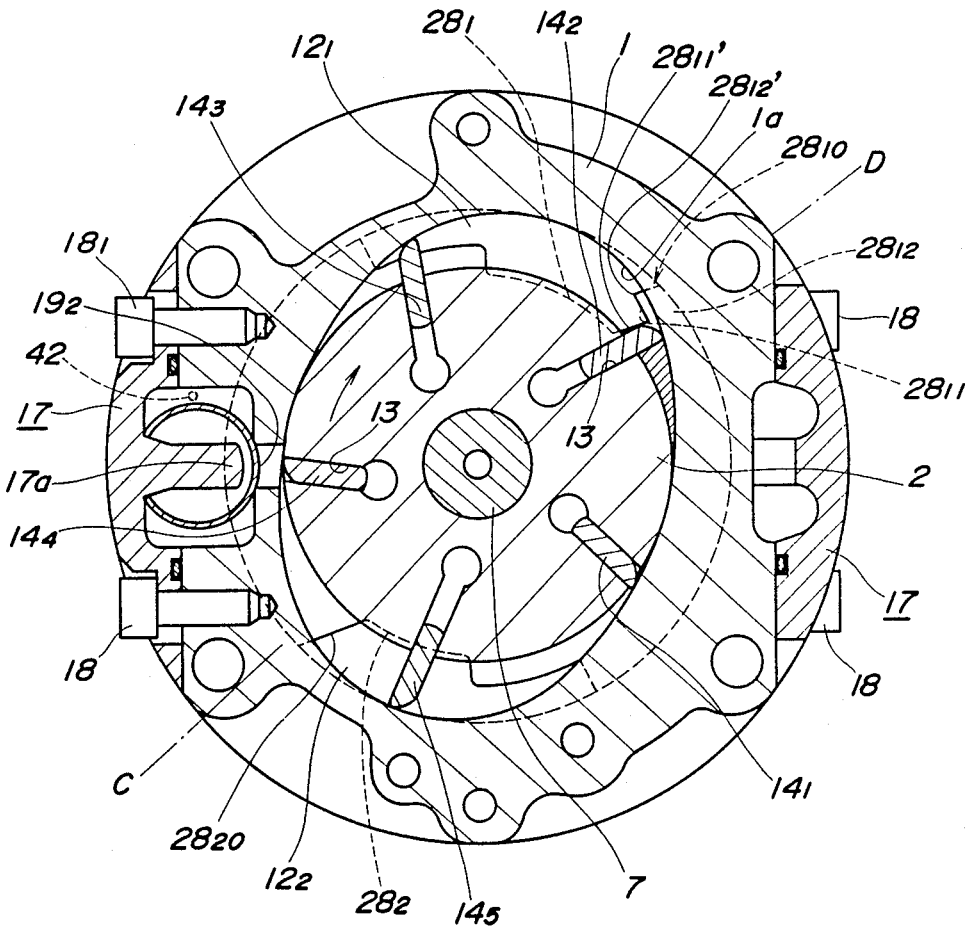
FIG. 3 is a view similar to FIG. 2, showing an control element in a partial capacity position.

On the other hand, when the compressor is operating at a high rotational speed, the suction pressure Ps is so low that the control valve device 31 is open and accordingly control pressure Pc leaks from the other second pressure chamber $26_2$ into the suction chamber 11 so that the control pressure Pc within the second pressure chambers $26_2$, $26_2$ is surpassed by the sum of the pressure Ps within the first pressure chambers $26_1$, $26_1$ and the force of the coiled spring 38 to thereby cause the control element 27 to rotate from the full capacity position shown in FIG. 2 into the partial capacity position shown in FIG. 3.

In the partial capacity position, the respective forward end edges $28_{10}$, $28_{20}$ of the cut-out portions $28_1$, $28_2$ are in the most forward position with respect to the rotation of the rotor 2. On this occasion, the compression stroke in the other compression space $12_2$ between two successive vanes $14_4$ and $14_5$, for example, commences when the trailing vane $14_5$ passes the forward end edge $28_{20}$ of the other cut-out portion $28_2$, i.e., passes the position C in FIG. 3. On the other hand, the compression stroke in the one compression space $12_1$ between two successive vanes $14_1$ and $14_2$, for example, does not commence until the trailing vane $14_2$ passes a bottom $28_{11}$, of the recess $28_{11}$ of the one cut-out portion $28_1$, i.e., passes the position D in FIG. 3. Specifically, in the partial capacity position, the span between the inner peripheral camming surface 1*a* of the cam ring 1 and the outer peripheral surface of the rotor 2 in the vicinity of the projecting portion $28_{12}$ is so short that very little part of the projecting portion $28_{12}$ intervenes between the other compression space $12_2$ and the inlet port 15 so that refrigerant gas within the other compression space $12_1$ is allowed to leak through a gap provided between the recess $28_{11}$ and the trailing vane $14_2$ into the inlet port 15, even after the trailing vane $14_2$ passes the edge $28_{12}$, of the projecting portion $28_{12}$ and until it reaches the bottom $28_{11}$, of the recess $28_{11}$ of the one cut-out portion $28_1$. Consequently, the timing of commencement of the compression stroke in the one compression space $12_1$ is retarded by a time period corresponding to the circumferential length of the recess $28_{11}$, as compared with the timing of commencement of the compression stroke in the other compression space $12_2$. Therefore, in the partial capacity position, the minimum delivery quantity or capacity of the one compression space $12_1$ is smaller than that of the other compression space $12_2$, whereby the variable range of the delivery quantity or capacity of the one compression space $12_1$ is wider than that of the other compression space $12_2$.

Further, in the compressor according to the invention, high pressure or discharge pressure Pd is supplied solely from the other compression space $12_2$ through the outlet port $16_2$, the passage $20_2$, the control pressure-supply port 42, the passage 41, and the restriction passage 40 into the one second pressure chamber $26_2$, wherefrom it is also supplied to the other second pressure chamber $26_2$ through the passage 43, thereby creating control pressure Pc within the both second pressure chambers $26_2$ and $26_2$. That is, control pressure Pc is supplied solely from the other compression space $12_2$, which provides a larger delivery quantity or capacity than the one compression space $12_1$. Therefore, the control pressure Pc can be promptly increased to a sufficiently high level upon starting of the compressor, thereby improving the startability of the compressor.

What is claimed is:

1. In a variable capacity vane compressor having a cylinder, a rotor rotatably received within said cylinder, a plurality of vanes radially slidably carried by said rotor, a pair of compression spaces defined between said cylinder and said rotor at diametrically opposite locations, a pair of refrigerant inlet ports formed in said cylinder in communication with respective corresponding ones of said compression spaces, a control element rotatably arranged in said cylinder, said control element having two cut-out portions formed therein and circumferentially extending at diametrically opposite locations through which said inlet ports and respective corresponding ones of said compression spaces are communicatable with each other, said cut-out portions being disposed relative to said respective corresponding ones of said compression spaces such that compression commences in each of said compression spaces when a trailing one of two successive ones of said vanes passes a forward end edge of a corresponding one of said cut-out portions with respect to the rotation of said rotor, said control element being rotatable between a partial capacity position and a full capacity position for varying the capacity of said compressor, the improvement wherein said forward end edge of one of said cut-out portions associated with one of said compression spaces has a circumferentially extending recess formed in a radially inner portion thereof, and a projecting portion formed by a radially outer portion thereof, whereby compression commences in said one of said compression spaces at retarded timing as compared with the other of said compression spaces when said control element is in said full capacity position.

2. A variable capacity vane compressor as claimed in claim 1, wherein said forward end edge of said one of said cut-out portions is formed such that most part of said projecting portion thereof intervenes between said one of said compression spaces and a corresponding one of said refrigerant inlet ports when said control element is in said full capacity position, and very little part of said projecting portion thereof intervenes between said one of said compression spaces and said corresponding one of said refrigerant inlet ports when said control element is in said partial capacity position.

3. A variable capacity vane compressor as claimed in claim 2, including at least one pair of first and second pressure chambers formed in said cylinder and disposed to be supplied, respectively, with lower pressure and higher pressure, said control element being rotatable in response to the difference between pressure within said first pressure chamber and pressure within said second pressure chamber, and pressure-supply means for supplying discharge pressure from the other of said compression spaces to said second pressure chamber.

4. A variable capacity vane compressor as claimed in claim 1, including at least one pair of first and second pressure chambers formed in said cylinder and disposed to be supplied, respectively, with lower pressure and higher pressure, said control element being rotatable in response to the difference between pressure within said first pressure chamber and pressure within said second pressure chamber, and pressure-supply means for supplying discharge pressure from the other of said compression spaces to said second pressure chamber.

5. A variable capacity vane compressor as claimed in claim 4, wherein said first pressure chamber is supplied with suction pressure in said compressor.

6. In a variable capacity compressor having a cylinder, a pair of compression spaces defined in said cylinder at diametrically opposite locations, a control element rotatably arranged in said cylinder, said control element having two cut-out portions formed in an outer peripery thereof and disposed relative to respective corresponding ones of said compression spaces such that compression starting timing in each of said compression spaces is determined by circumferential position of a corresponding one of said cut-out portions, said cut-out portions being different in at least one of configuration and circumferential position thereof from each other such that compression starting timing in one of said compression spaces is retarded as compared with that in the other of said compression spaces, and at least one pair of first and second pressure chambers formed in said cylinder, said control element being rotatable in response to the difference between pressure within said first pressure chamber and pressure within said second pressure chamber, the improvement comprising pressure-supply means for supplying discharge pressure solely from the other of said compression spaces to said second pressure chamber.

* * * * *